US007422488B1

(12) United States Patent
Wu

(10) Patent No.: US 7,422,488 B1
(45) Date of Patent: Sep. 9, 2008

(54) EXTENSION TO ELECTRICAL CONNECTOR WITH IMPROVED CONTACT ARRANGEMENT AND METHOD OF ASSEMBLING THE SAME

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/982,660

(22) Filed: Nov. 2, 2007

(51) Int. Cl.
*H01R 24/00* (2006.01)

(52) U.S. Cl. ..... 439/676

(58) Field of Classification Search ..... 439/626, 439/357, 108, 607
See application file for complete search history.

(56) References Cited

U.S. PATENT DOCUMENTS

| | | | | |
|---|---|---|---|---|
| 6,039,611 | A * | 3/2000 | Yang | 439/701 |
| 6,338,652 | B1 * | 1/2002 | Ko | 439/579 |
| 6,976,869 | B1 * | 12/2005 | Wu | 439/499 |
| 7,021,971 | B2 | 4/2006 | Chou et al. | |
| 7,086,888 | B2 * | 8/2006 | Wu | 439/358 |
| 7,104,848 | B1 | 9/2006 | Chou et al. | |
| 7,108,560 | B1 | 9/2006 | Chou et al. | |
| 7,125,287 | B1 | 10/2006 | Chou et al. | |
| 7,134,884 | B2 | 11/2006 | Wang et al. | |
| 2005/0186830 | A1 * | 8/2005 | Wu | 439/358 |
| 2006/0025015 | A1 | 2/2006 | Hu et al. | |
| 2006/0261474 | A1 | 11/2006 | Jiang et al. | |
| 2006/0286865 | A1 | 12/2006 | Chou et al. | |
| 2006/0294272 | A1 | 12/2006 | Chou et al. | |

FOREIGN PATENT DOCUMENTS

| | | |
|---|---|---|
| CN | 2891389 Y | 4/2007 |
| CN | 2922162 Y | 7/2007 |
| TW | M306723 | 2/2007 |

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector (100) includes an insulative housing (2) extending in a front-to-back direction, a first set of contacts (3) held in the insulative housing, and a second set of contacts (4) held in the insulative housing and including at least one pair of differential contacts (41) held in the insulative housing for transferring high-speed signals. Each first contact includes a nonelastic contact portion (36). Each of the second set of contacts includes an elastic contact portion (43) located behind the nonelastic contact portion along the front-to-rear direction. At least one set of first and second sets of contacts are permanently held in the insulative housing, while the other set of first and second sets of contacts is replaceably held in the insulative housing.

16 Claims, 10 Drawing Sheets

EXTENSION TO ELECTRICAL CONNECTOR WITH IMPROVED CONTACT ARRANGEMENT AND METHOD OF ASSEMBLING THE SAME

CROSS-REFERENCE TO RELATED APPLICATIONS

This application is related to U.S. patent application Ser. No. 11/818,100, filed on Jun. 13, 2007 and entitled "EXTENSION TO UNIVERSAL SERIAL BUS CONNECTOR WITH IMPROVED CONTACT ARRANGEMENT", which has the same assignee as the present invention.

BACKGROUND OF THE INVENTION

1. Field of the Invention

The present invention relates to an electrical connector, more particularly to an electrical connector compatible to standard Universal Serial Bus (USB) 2.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. Such kind electrical connectors are disclosed in a U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are held on the top tongue portion and additional contacts are accommodated on the lower tongue portion of the receptacle. With contrast with existing USB type-A receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent are viable options to add so many contacts. As fully discussed above, the receptacle equipped with two tongue portions or plug and receptacle both with a longer length are also clumsiness. That is not very perfect from a portable and small size standpoint.

BRIEF SUMMARY OF THE INVENTION

Accordingly, an object of the present invention is to provide an electrical connector with low profile and lower cost.

Another object of the present invention is to provide a method of assembling the electrical connector the same.

In order to achieve the above-mentioned object, an electrical connector comprises an insulative housing extending in a front-to-rear direction, a first set of contacts held in the insulative housing, and a second set of contacts held in the insulative housing and comprising at least one pair of differential contacts held in the insulative housing for transferring high-speed signals. Each first contact comprises a nonelastic contact portion. Each of the second set of contacts comprises an elastic contact portion located behind the nonelastic contact portion along the front-to-rear direction. At least one set of first and second sets of contacts are permanently held in the insulative housing, while the other set of first and second sets of contacts is replaceably held in the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
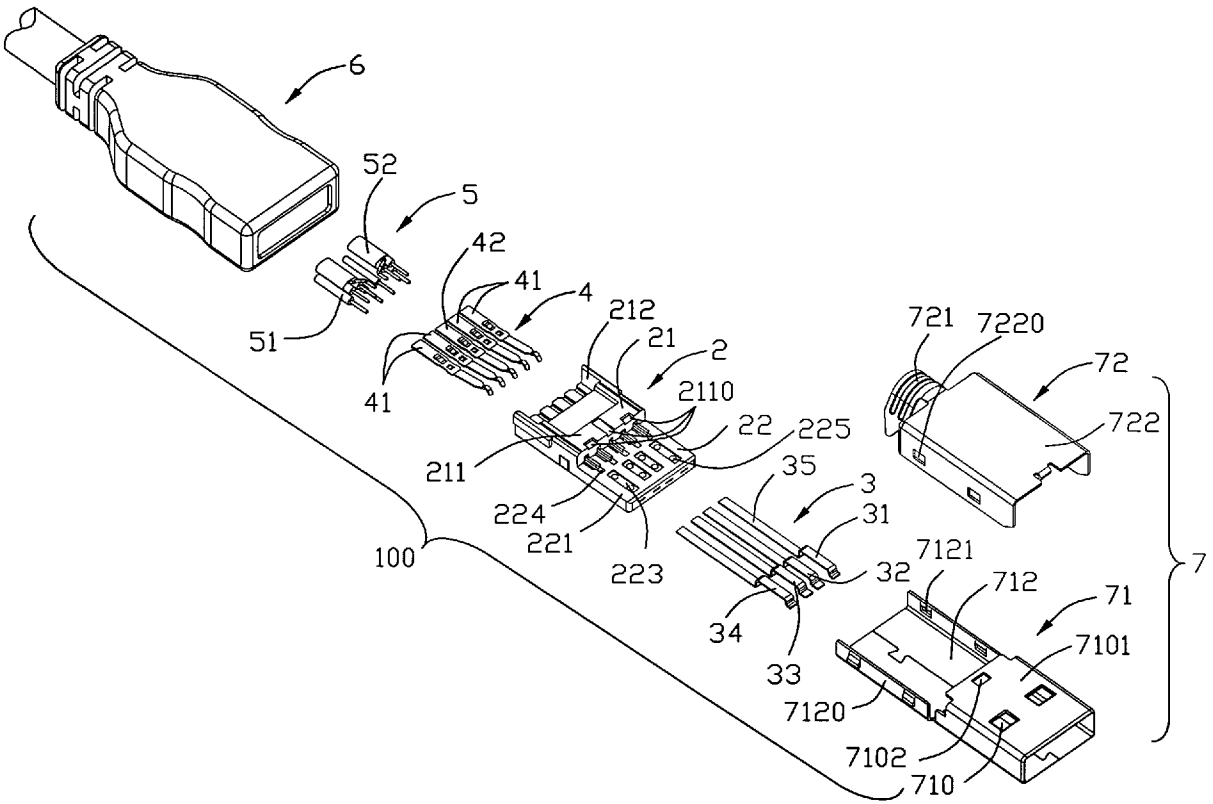
FIG. 1 is an exploded, perspective view of an extension to an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Figure 2:
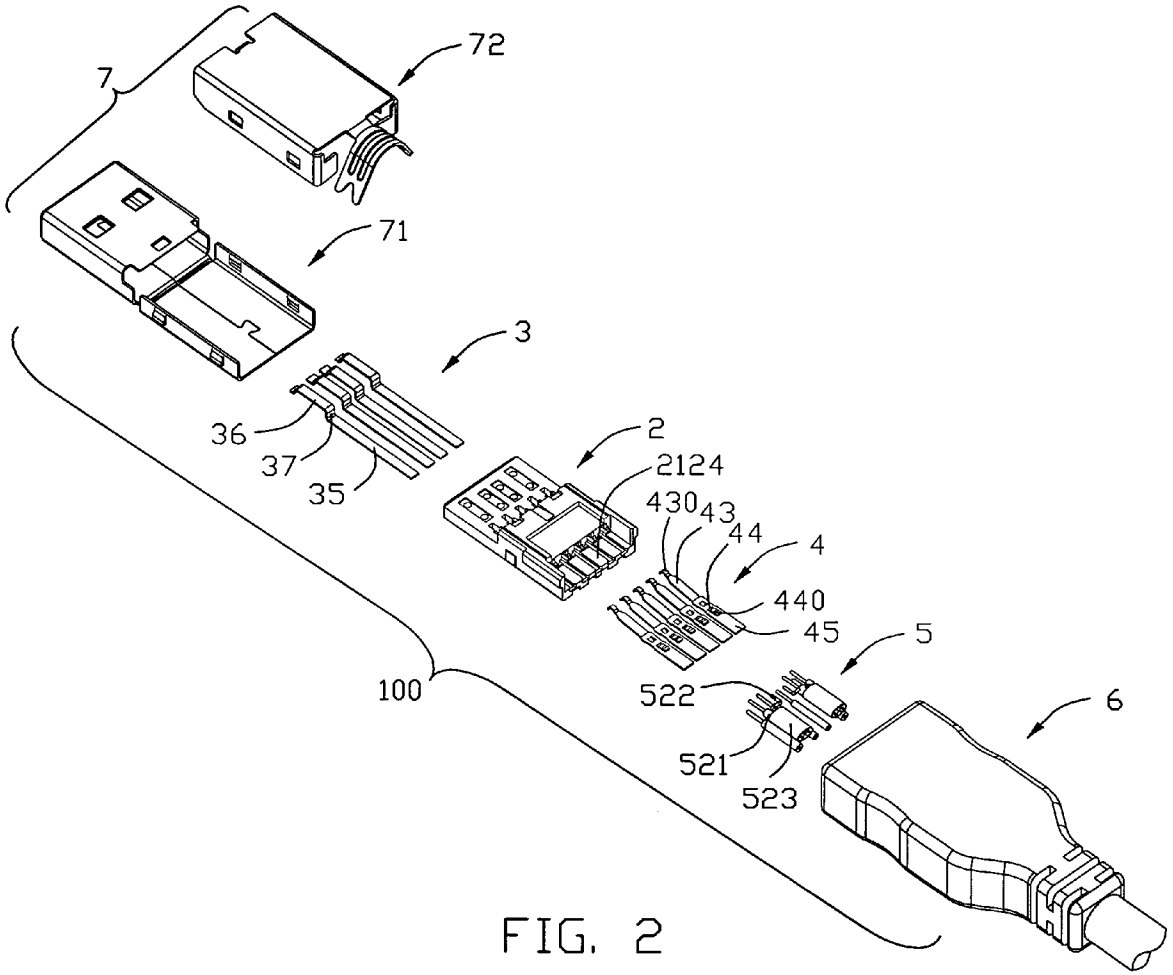
FIGS. 2-3 are views similar to FIG. 1, but viewed from different aspects.
Figure 3:
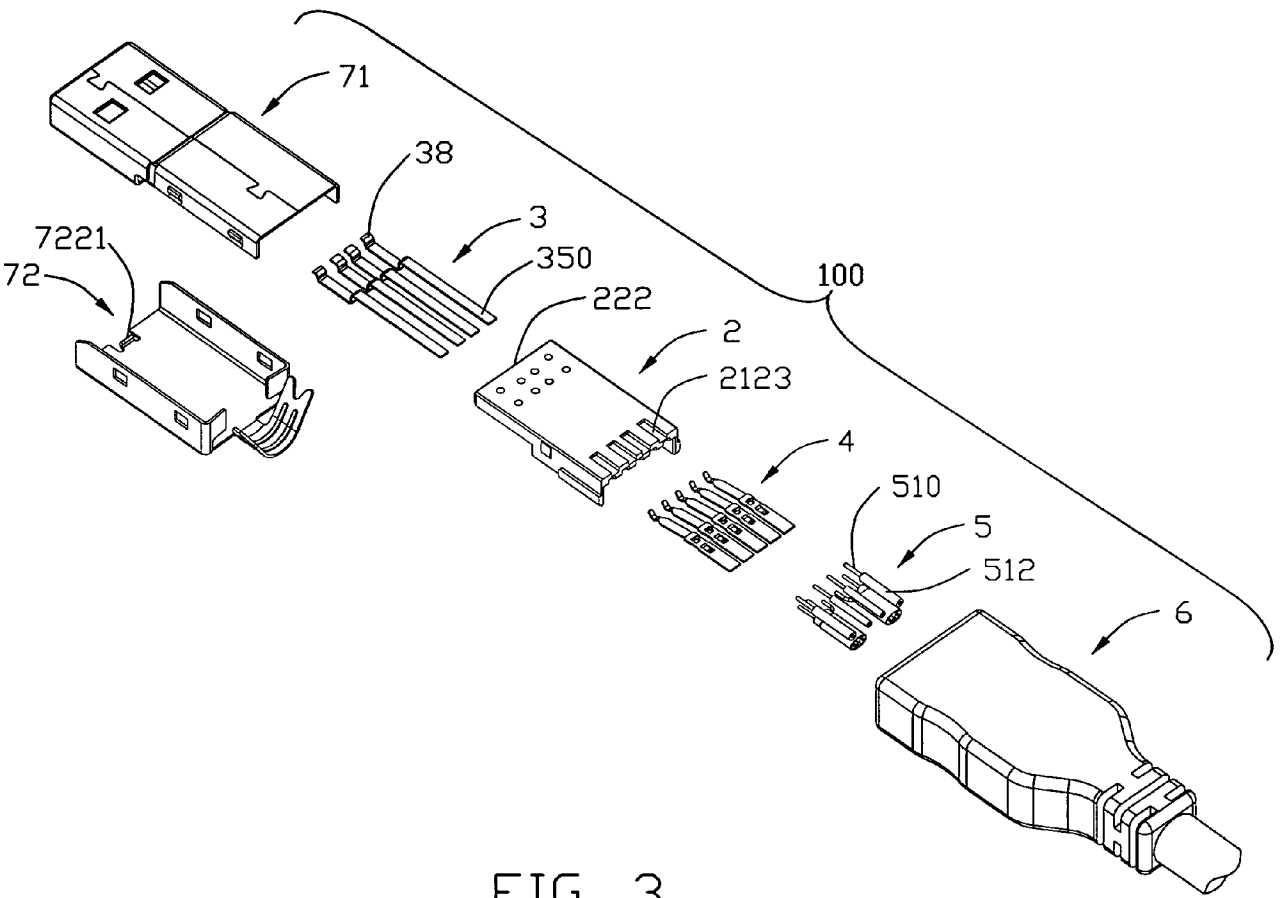

Referring to FIGS. 1-3, an extension to an electrical connector 100, that is a USB plug 100, according to the present invention is disclosed. The extension to USB plug 100 comprises an insulative housing 2 which has an insulative base portion 21 and an insulative tongue portion 22 extending from the insulative base portion 21 in a front-to-rear direction, a first set of contacts 3 and a second set of contacts 4 supported in the insulative housing 10, and a metal shell 7 enclosing the insulative housing 10 and the contacts 13, 16. Besides, a cable 5 having first and second sets of wires 51, 52 to electrically connect with the contacts 3, 4. In order to provide a strong structure of the extension to USB plug 100, an outer insulative cover 6 is over molded on a rear section of the insulative housing 2 together with the metal shell 7 and the cable 5. The outer insulative cover 6 is adapted for being grasped by a user when the extension to USB plug 100 is used. Detail description of these elements and their relationship and other elements formed thereon will be detailed below.

Referring to FIGS. 1-3, the base portion 21 and the tongue portion 22 of the insulative housing 2 are integrally injecting molded as a unit one piece. The base portion 21 comprises a front engaging section 211 for engaging with the metal shell 7 and a rear terminating section 212 for the termination between the contacts 3, 4 and the wires 51, 52. The engaging section 211 defines a plurality of cutouts 2110 in upper surface thereof adjacent to a front surface thereof for engaging with the metal shell 7. Four first passageways 2111 and five second passageways 2112 are arranged in an upper row and a lower row to protrude through the engaging section 211 of the base portion 21 for receiving the first and second sets of contacts 3, 4. The rear termination section 212 is of U-shape and comprises a pair of lateral walls 2121 and a transversal flat board 2122 connecting with the lateral wall 2121. Four first channels 2123 and five second channels 2124 respectively aligning with the first and second passageways 2111, 2112 are respectively defined in lower and upper surfaces of the flat board 2122 for exposing tail portions of the first and second sets of contacts 3, 4 for soldering with the first and second wires 51, 52.

The tongue portion 22 has a first supporting surface 221 lower than the upper surface of the base portion 21 and opposite second supporting surface 222 coplanar with lower surface of the base portion 22. Four first passages 223 and five second passages 224 respectively recess downwardly from the first supporting surface 221 of the tongue portion 22 and are arranged in a front row and communicating with the first passageways 2111 in height direction and a rear row aligning with the second passageways 2112 in front-to-back direction. Four tip openings 225 are recessed inwardly from the front surface of the tongue portion 22 to communicate with the first passages 223 for receiving corresponding parts of the first set of contacts 3. A pair of through holes 225 is defined in each first passage 223 to communicate with the first and second supporting surfaces 221, 222 and is arranged in the first passage 223 along front-to-back direction for pins of die to hold the first contacts 3 when molding to assure the relative position between the insulative housing 2 and the first contacts 3.

Figure 4:
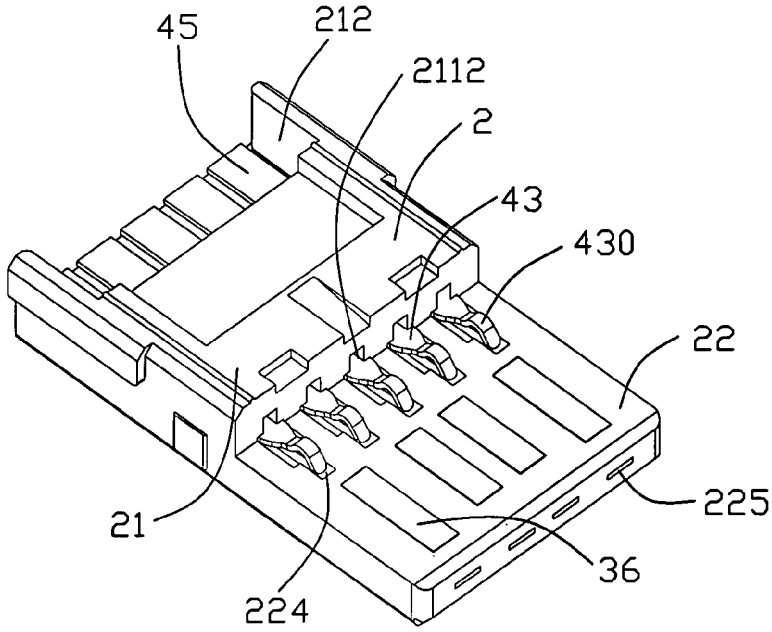
FIGS. 4-6 are partially assembled views of FIGS. 1-2.
Figure 5:
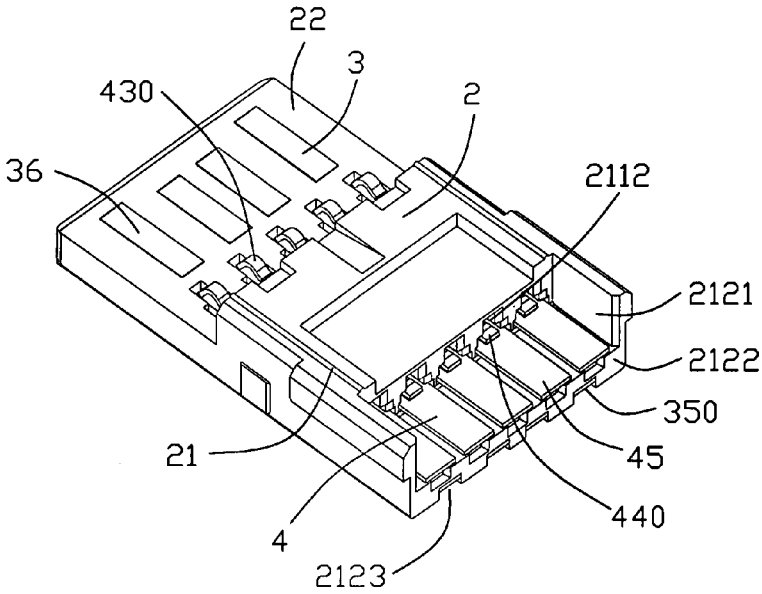
Figure 6:
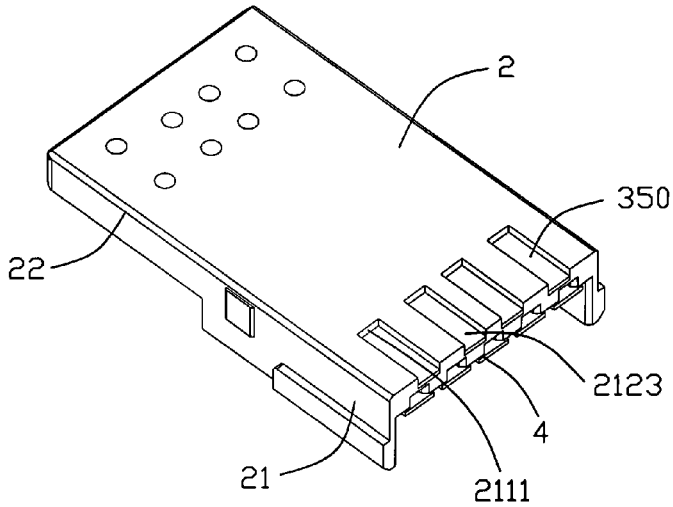
Figure 7:
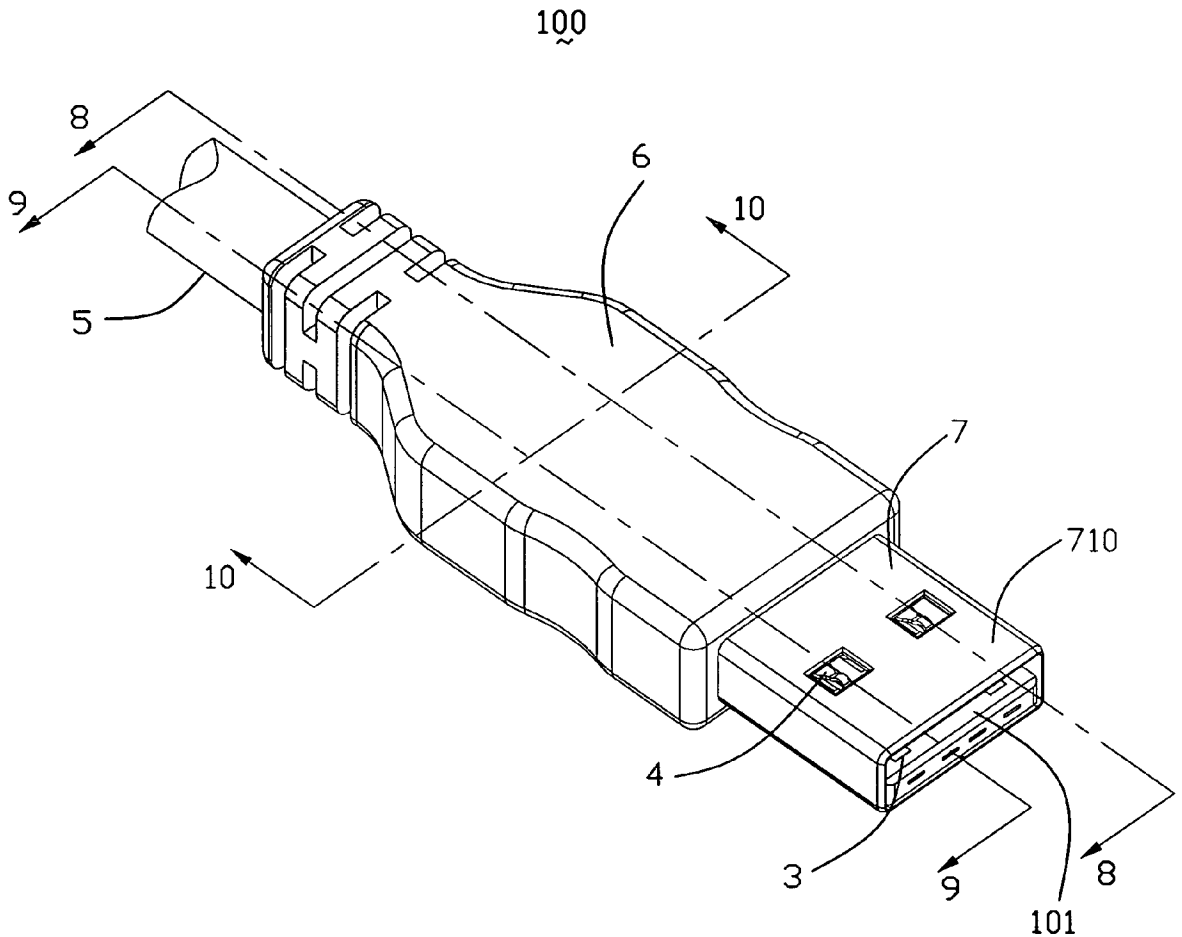
FIG. 7 is an assembled view of FIG. 1.
Figure 8:
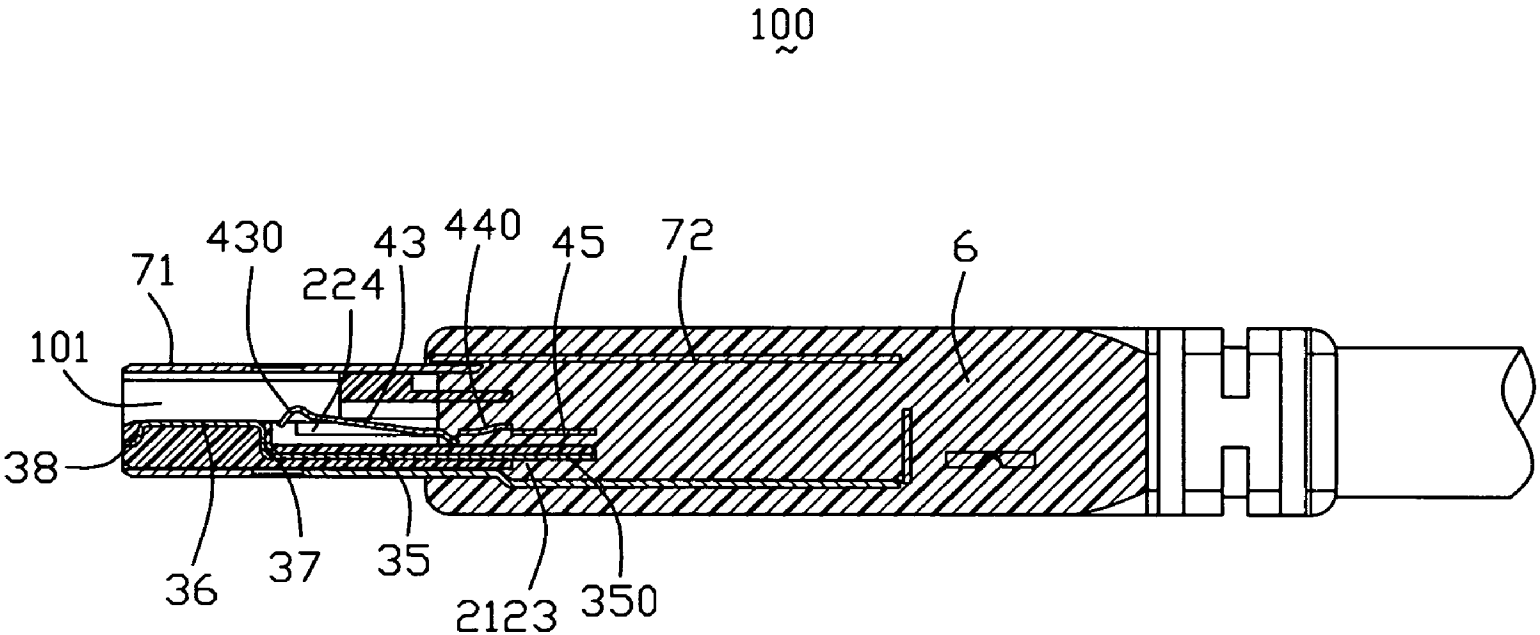
FIGS. 8-10 are cross-section views taken along lines 7-7 to 10-10 of FIG. 7.
Figure 9:
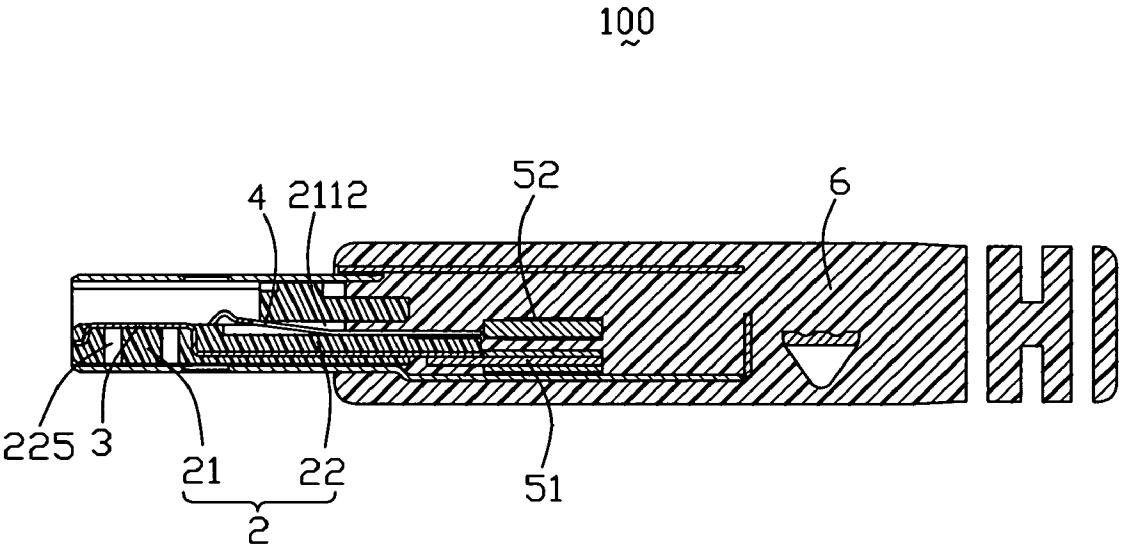
Figure 10:
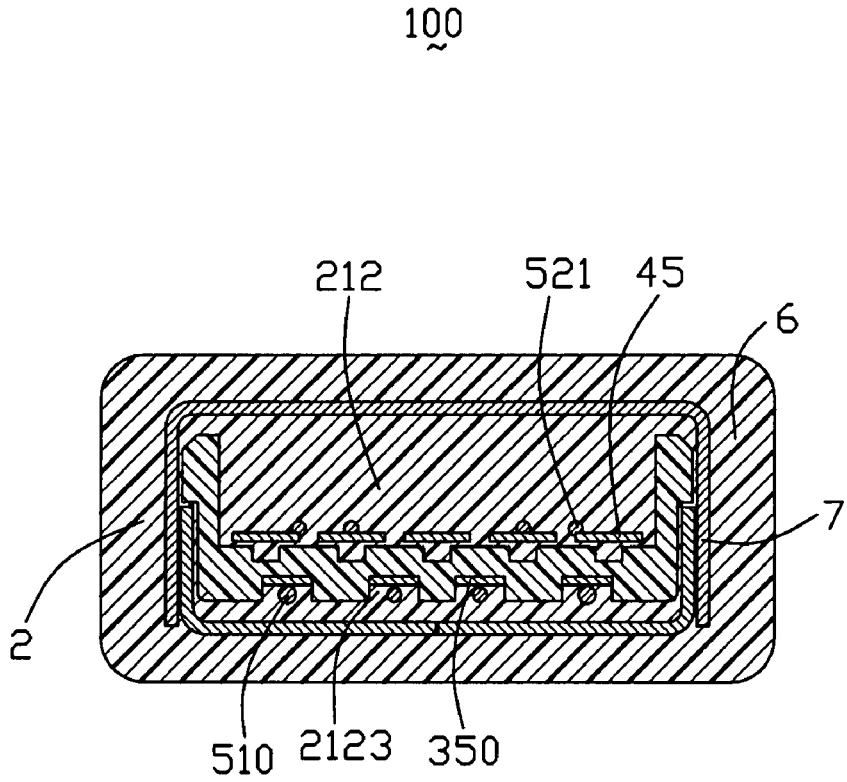

Referring to FIGS. 1-3 in conjunction with FIGS. 4-6, the first set of contacts 3 include four plug conductive contacts designated with numeral 31, 32, 33 and 34. The four first contacts 3 are insertmolded with the insulative housing 2 when forming the insulative housing 2. Thus, the insulative housing 2 has better intensity and assembly time is decreased. Each first contact 3 comprises a rear flat body section 35 received in the first passageways 2111 with rear tail section 350 thereof exposed in the first channel 2123, a flat contacting section 36 embedded in the first passage 223 and coplanar with the first supporting surface 221, a vertical connecting section 37 connecting with the body section 35 and the contacting section 36 and embedded in the tongue portion 22, and a front L-shape tip end 38 embedded in the front opening 225 for preventing the upward deflection of the contacting section 36. The four first contacts 3 are juxtaposed arranged and the contacting sections 36 thereof are nonelastic. The body section 35 is parallel to the contacting section 36 and is much longer than the contacting section 36.

The additional second set of contacts 4 include two pairs of differential contacts 41 and a grounding contact 42. The two pairs of differential contacts 41 are used for transferring/receiving high-speed signals, and the grounding contact 42 is disposed between the two pairs of differential contacts 41 for preventing cross-talk. Each differential contact 41 of each pair comprises an elastic contact portion 43 formed with an elastic contacting end 430 curved upwardly, a middle retention portion 44 formed with a pair of retention tabs 440 arranged along front-to-back direction and a flat tail portion 45 extending rearwardly from the retention portion 44. The second contacts 4 are inserted into the insulative housing 2 from rear-to-front direction with the retention portions 44 interferentially engaging with inner walls of the second passageways 2112 via the retention tabs 440, the elastic contact portions 43 partially received in the second passages 224 and the contacting ends 430 exposed beyond the first supporting surface 221 of the tongue portion 22, and the tail portions 45 exposed in the termination section 212 and locating in the second channels 2124 for soldering with the second wires 52. Thus, the differential contacts 41 and the grounding contact 42 are juxtaposed with respect to one another along the front-to-rear direction. The contacting sections 36 of the four first set of contacts 31, 32, 33 and 34 occupy a majority of length of the tongue portion 22 along the front-to-rear direction with respect to that of the contact portions 43 of the additional second set of contacts 4. Meanwhile, the tail portions 45 are offset from the tail sections 350 of the first set of contacts 31, 32, 33 and 34 in a height direction perpendicular to the front-to-rear direction. The tail portions 45 are located under the tail sections 350 of the first set of contacts 31, 32, 33 and 34 to prevent electrical shorting. Besides, each contact portion 43 is cantileveredly received in the second passages 224 and protrudes upwardly beyond the supporting surface 121 so that the contact portion 43 is elastic and deformable when engaging with corresponding contacts of an extension to USB receptacle (not shown). The contact portions 43 and the contacting sections 36 are separated in the front-to-rear direction with no portion of them contacting one another.

The extension to USB plug 100 is compatible to existing standard USB receptacle. The geometric profile of the tongue portion 22 is same as that of the standard USB plug within an allowable tolerance. That is, length, width and height of the tongue portion 22 are substantially equal to those of the standard USB plug. An arrangement of the four first set of contacts 31, 32, 33 and 34 is compatible to that of the standard USB receptacle. The four first contacts 31, 32, 33 and 34 are for USB protocol to transmit USB signals. In detail, the four first set of contacts 31, 32, 33 and 34 are for power (VBUS) signal, –data signal, +data signal and grounding, respectively. So now, from assignment of each first contacts standpoint, different terminology are given to each of the four first set of contacts 31, 32, 33 and 34, wherein the first contacts 31, 32, 33 and 34 are respectively named as power contact 31, –data contact 32, +data contact 33 and ground contact 34.

Referring to FIGS. 1-3 in conjunction with FIGS. 7-10, the metal shell 7 comprises a lower first half 71 and an upper second half 72 engaging with the first half 71 to form the whole metal shell 7. The first half 71 comprises a front tube-shape mating frame 710 and a rear U-shape holding section 712 with opposite flanges 7120 each formed with a pair of tubers 7121 bending outwardly for engaging with locking holes 7220 of the second half 72 to secure the first and second halves 71, 72. The front mating frame 710 defines two pairs of rectangular windows 7101 in upper and lower walls thereof and a rear locking opening 7102 in upper wall adjacent to the holding section 712. The second half 72 is assembled to the rear holding section 712 of the first half 71 and comprises a n-shape front holding section 720 and a rear crimping section 721 for grasping the cable 5 to realize strain relief. The holding section 722 forms two pairs of locking holes 7220 in opposite lateral walls thereof and a bending tab 7221 bending from a front edge of upper wall thereof to lock into the locking opening 7102 of the first half 71. After the metal shell 7 is assembled to the insulative housing 2 and the contacts 3, 4, the mating frame 710 of the metal shell 7 touches other three sides of the tongue portion 22 except the first supporting surface 221, thus, a receiving cavity 101 circumscribed by the mating frame 710 and the first supporting surface 221 is formed. The contacting sections 36 of the first set of contacts 3 and the contact portions 43 of the second set of contacts 4 are all exposed in the receiving cavity 101 surrounded by the mating frame 710 and first supporting surface 221 for mating with corresponding contact portions of a complementary connector. An arrangement of the metal shell 7 and the tongue portion 22 is also compatible with what of standard USB receptacle.

In the preferred embodiment of the present invention, the first set of contacts 3 are all formed of a metal sheet and separated form one another. It is also to be understood that, in other embodiments, the first contacts 31, 32, 33 and 34 can be conductive pads formed on a printed circuit board which is supported on the supporting surface 221 of the tongue portion 22. These two options to make contacts are both viable in current industry.

The cable 5 comprises the four first wires 51 arranged in a lower row to be soldered with the tail sections 350 of the first set of contacts 3 and a pair of second wires 52 arranged in an upper row to be soldered with the tail portions 45 of the second set of contacts 4. Each first wire 51 comprises an inner conductor 510 soldered with the tail section 350 and an outer jacket 512 enclosing the inner conductor 510. Each second wire 52 comprises a pair of differential pair 521 each having the same structure as that of the first wire 51, a grounding conductor 522, and an outer jacket 523 enclosing the differential pair 521 and the grounding conductor 522. The two differential pairs 521 of the second wires 52 are respectively soldered to the tail portions 45 of the differential contacts 41, while the pair of grounding conductors 522 are both soldered to the single grounding contact 42. The metal shell 7 is assembled of the insulative housing 2, the contacts 3, 4 and the cable 5 as described above. Then, the outer insulative cover 6 is overmolded with the metal shell 7, the cable 5.

Under the non-USB protocol, the two pairs of differential contacts 41 transfer differential signals unidirectionally, one pair for receiving data and the other for transmission data.

In the preferred embodiment of the present invention, the number of the additional second set of contacts 4 is five which consists of two pairs of differential contacts 41 and a grounding contact 42 disposed between each pair of the differential contacts 41 as best shown in FIGS. 1-3. However, in alternative embodiments, the additional second set of contacts 4 can only comprise a pair of differential contacts for transmitting/receiving high-speed signals, and if necessarily, a grounding contact can be provided to be positioned on each lateral side of the pair of differential contacts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

The invention claimed is:

1. An electrical connector, comprising:

an insulative housing extending in a front-to-back direction; and a first set of contacts held in the insulative housing, each first contact comprising a nonelastic contact portion;

a second set of contacts held in the insulative housing and comprising at least one pair of differential contacts held in the insulative housing for transferring high-speed signals, and each of the second set of contacts comprising an elastic contact portion located behind the nonelastic contact portion along the front-to-back direction; and wherein at least one set of the first and second sets of contacts are permanently held in the insulative housing, while the other set of the first and second sets of contacts is assembled to the insulative housing along front-to-back direction;

wherein the insulative housing comprises a base portion and a front tongue portion, and wherein the first and second sets of contacts are held in the base portion with the elastic contact portions and the nonelastic contact portions are arranged in the tongue portion;

wherein the tongue portion comprises a supporting surface, and wherein the nonelastic contact portions of the first set of contacts are substantially coplanar with the supporting surface of the tongue portion and wherein the elastic contact portions of the second set of contacts are beyond the supporting surface;

wherein the first set of contacts is adapted for USB protocol and an arrangement of the first set of contacts is compatible to a standard USB receptacle, and wherein the pair of differential contacts are adapted for non-USB protocol;

wherein the second set of contacts further comprises a ground contact.

2. The electrical connector as claimed in claim 1, wherein a geometric profile of the tongue portion is substantially same as that of a standard type-A USB 2.0 plug.

3. The electrical connector as claimed in claim 1, wherein the nonelastic contact portions of the first set of contacts occupy a majority of length of the tongue portion along front-to-back direction with respect to the elastic contact portions of the second set of contacts.

4. The electrical connector as claimed in claim 1, wherein the first set of contacts are permanently held in the insulative housing, and wherein the second set of contacts are replaceably held in the insulative housing.

5. The electrical connector as claimed in claim 1, wherein each of the first contact comprises a tail section parallel to the nonelastic contact portion to locate below the nonelastic contact portion, and wherein the nonelastic contact portion and the tail section of the first contact are respectively located at opposite sides of the insulative housing.

6. The electrical connector as claimed in claim 1, wherein each first contact comprises a tail section, and each second contact comprises a tail portion, and wherein the nonelastic contact portions and the elastic contacts are located at the same side of the insulative housing, while the tail sections and the tail portions of the first and second sets of contacts are located at opposite sides of the insulative housing.

7. The electrical connector as claimed in claim 1, wherein each first set of contacts comprises an L-shape tip end formed with the nonelastic contact portion to be embedded in the insulative housing for preventing upward deflection of the nonelastic contact portion.

8. A method of assembling an electrical connector as claimed in claim 1, comprising the steps of:

a) providing a first set of contacts, each first contact comprising a nonelastic contact portion;

b) positioning the first set of contacts in a mold;

c) providing insulative material to inject into the mold;

d) cooling the mold to form an insulative housing with the first set of contacts insertmolded with the insulative housing;

e) providing at least one pair of differential contacts, each differential contact comprising an elastic contact portion;

f) assembling the at least one pair of differential contacts to the insulative housing; and g) the elastic contact portions of the at least one pair of differential contacts are located behind the nonelastic contact portions of the first set of contacts.

9. The electrical connector as claimed in claim 1, further comprising the pair of differential contacts served as second set of contacts held in the insulative housing and juxtaposed arranged with the original differential second set of contacts.

10. The electrical connector as claimed in claim 9, further comprising the ground contact located between the two pairs of differential contacts.

11. The electrical connector as claimed in claim 1, wherein each of the second contact comprises a tail portion rearwardly extending from the elastic contact portion, and wherein the tail portion and the elastic contact portion are located at the same side of the insulative housing.

12. The electrical connector as claimed in claim 11, further comprising a cable comprising a plurality of first wires and at least one second wire respectively electrically connecting with the tail sections and the tail portions of the first and second sets of contacts.

13. The electrical connector as claimed in claim 12, wherein each first wire comprises an inner conductor soldered with the tail section of the first set of contacts and an outer jacket enclosing the inner conductor.

14. The electrical connector as claimed in claim 12, wherein the at least one second wire comprises a pair of differential pair respectively soldered with the solder portions of the second set of contacts.

15. The electrical connector as claimed in claim 14 wherein the at least one second wire further comprises a grounding conductor soldered with the ground contact.

16. An electrical cable connector comprising:

an insulative housing defining a mating tongue with a mating face thereon;

a metallic shell enclosing said housing and cooperating with said mating face to form a mating port, while another face of the mating tongue opposite to the mating face being essentially intimately shielded by said shell;

a deflectable first contact disposed in the housing and extending relative adjacent to said mating face with a first contacting section exposed upon a rear region mating face; and a stiff second contact disposed in the housing and extending relative farther from said mating face in comparison with said first contact, while with a second contact section deflected to and exposed upon the mating face; and at least one opening formed in the mating tongue and extending through the mating face and said another face, and directly communicatively shielded with said second contact, via which the second contact communicates with a portion of the shell on said another face;

a first contacting section of said first contact is substantially coplanar with a supporting surface of the mating tongue of the housing;

wherein said first contact is adapted for USB protocol and an arrangement of the first contact is compatible to a standard USB receptacle and wherein a pair of differential contacts of the second contact are adapted for non-USB protocol;

wherein the second contact further comprises a ground contact;

wherein said opening extends in a vertical direction perpendicular to a mating direction of a cable connector.

* * * * *